US005633653A

United States Patent [19]

Atherton

[11] Patent Number: 5,633,653

[45] Date of Patent: May 27, 1997

[54] SIMULTANEOUS SAMPLING OF DEMULTIPLEXED DATA AND DRIVING OF AN LCD PIXEL ARRAY WITH PING-PONG EFFECT

[75] Inventor: James H. Atherton, Ringoes, N.J.

[73] Assignee: David Sarnoff Research Center, Inc., Princeton, N.J.

[21] Appl. No.: 298,295

[22] Filed: Aug. 31, 1994

[51] Int. Cl.[6] ..... G09G 3/36

[52] U.S. Cl. ..... 345/98; 345/206; 345/204

[58] Field of Search ..... 345/98–100, 104, 345/204–205, 206; 318/135; 348/790, 791, 799, 800

[56] References Cited

U.S. PATENT DOCUMENTS

| | | | |
|---|---|---|---|
| 4,781,437 | 11/1988 | Shields et al. | 318/135 |
| 4,845,482 | 7/1989 | Howard et al. | 345/100 |
| 4,922,240 | 5/1990 | Duwaer | 345/100 |
| 5,006,840 | 4/1991 | Hamada et al. | 345/98 |
| 5,028,916 | 7/1991 | Ichikawa et al. | 345/90 |
| 5,111,195 | 5/1992 | Fukuoka et al. | 345/204 |
| 5,166,771 | 11/1992 | Maekawa | 345/100 |
| 5,170,155 | 12/1992 | Plaus et al. | 345/100 |
| 5,200,741 | 4/1993 | Usui | 245/45 |
| 5,252,957 | 10/1993 | Itakura | 345/98 |
| 5,335,023 | 8/1994 | Edwards | 345/100 |
| 5,426,447 | 6/1995 | Lee | 345/103 |
| 5,459,483 | 10/1995 | Edwards | 345/100 |

FOREIGN PATENT DOCUMENTS 0441692 8/1991 European Pat. Off. .

*Primary Examiner*—Jeffery Brier
*Assistant Examiner*—Martin Loui
*Attorney, Agent, or Firm*—William J. Burke

[57] ABSTRACT

A data driver circuit for an LCD including a switching circuit for transferring a data signal from a data channel to a first data line and a second data line. Also included is a sample circuit which alternately samples the data signal from the first data line and the second data line to produce and store respectively a first and second sampling data signal during a respective first and second time period. A data driver retrieves from the sample circuit the first sample data signal during the second time period and the second sampled data signal during the first time period. Then, the data driver transfers a driving pulse corresponding to one of the first sampled data signal and the second sampled data signal to the display.

21 Claims, 13 Drawing Sheets

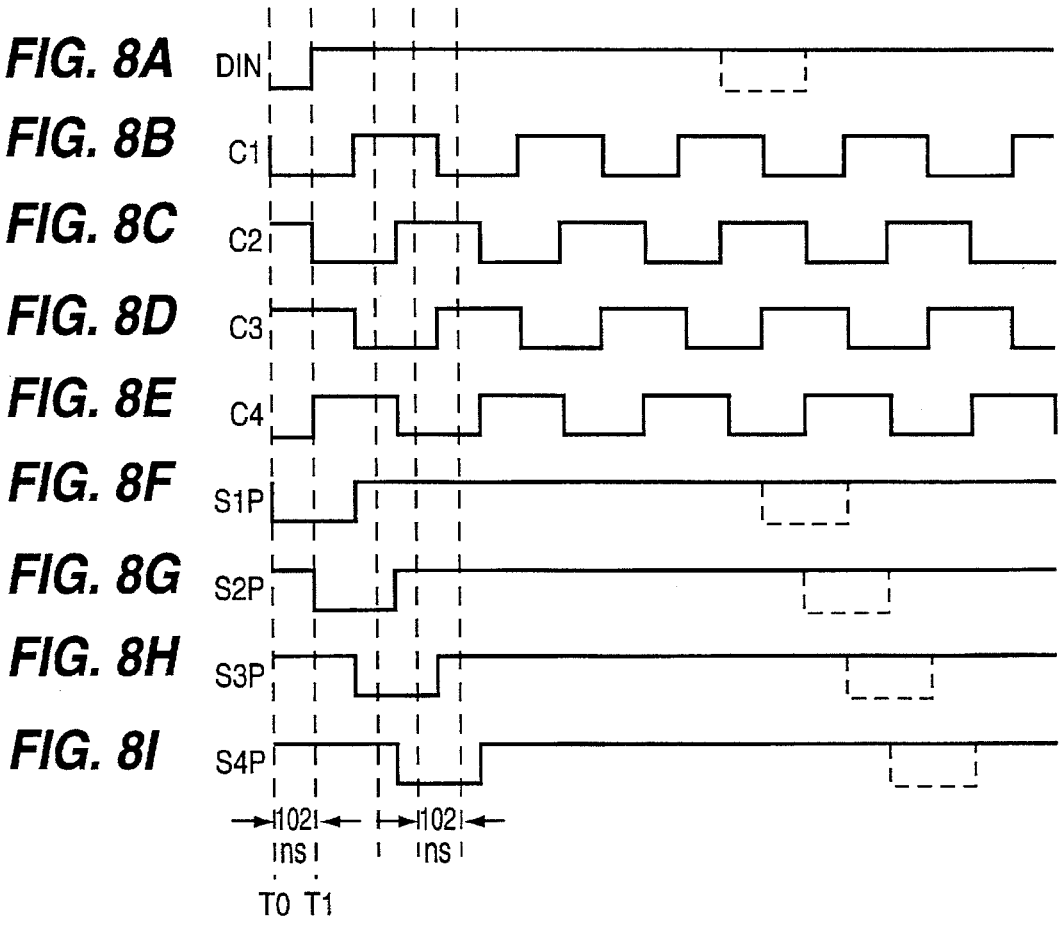
FIG. 8A
DIN
FIG. 8B
C1
FIG. 8C
C2
FIG. 8D
C3
FIG. 8E
C4
FIG. 8F
S1P
FIG. 8G
S2P
FIG. 8H
S3P
FIG. 8I
S4P
102 ns
102 ns
T0 T1
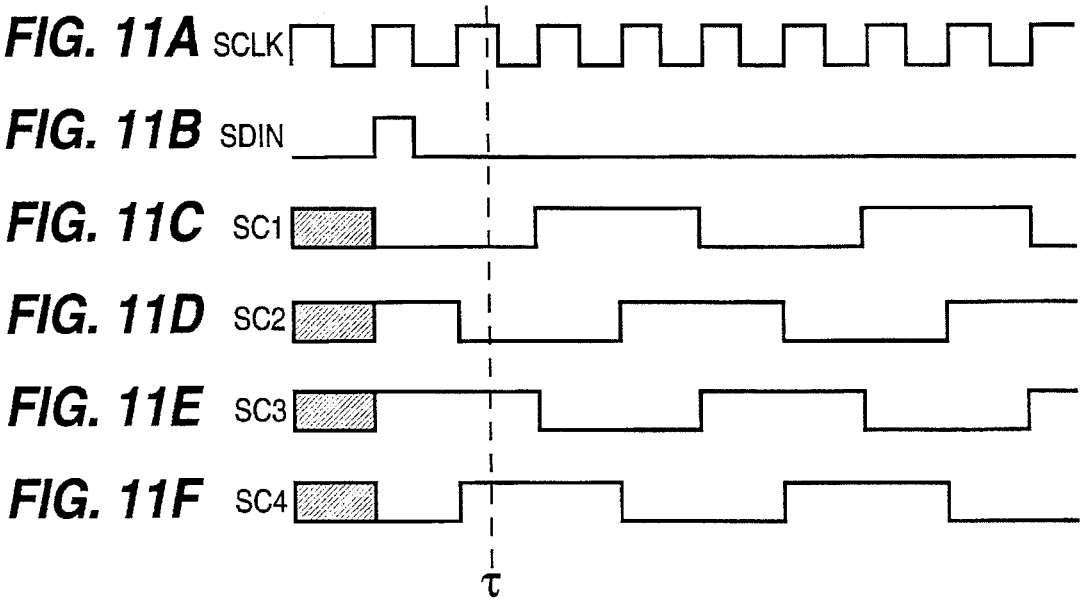
FIG. 11A SCLK
FIG. 11B SDIN
FIG. 11C SC1
FIG. 11D SC2
FIG. 11E SC3
FIG. 11F SC4
τ

SIMULTANEOUS SAMPLING OF DEMULTIPLEXED DATA AND DRIVING OF AN LCD PIXEL ARRAY WITH PING-PONG EFFECT

This invention was made with Government support under Contract No. F33615-92-C-3804 awarded by the U.S. Department of the Air Force. The Government has certain rights in this invention.

This invention relates to a driving circuit for a matrix type display device, and more particularly to a driving circuit for a matrix type liquid crystal display.

BACKGROUND OF THE INVENTION

As a result of rapid advances in design and manufacturing technology, liquid crystal displays (LCD) have recently become available which have a display quality that can match that of cathode ray tubes. However, to achieve the higher resolution for LCDs, it is necessary to drive the LCDs at accelerated speeds. Consequently, various attempts have been made for designing circuitry for driving LCDs at accelerated speeds.

In such LCDs, a signal, such as an analog or digital video signal, is used to control a pixel. This signal is applied on a number of columns by buses or "display lines" and is selectively gated at the appropriate time to each pixel of the display by gate signals applied to rows or gate supply buses.

Such displays typically employ one line driver per display line, sometimes referred to as "data driver". The data drivers are typically arrayed along an edge of the display substrate along a distance of several inches. The data drivers provide data to the pixel array a row at a time. The particular row is identified by a select scanner which sequentially selects each row of the pixel array to receive data from the data drivers.

In a preferred design, the LCDs include Sample/Hold (S/H) circuits. Generally, each S/H circuit includes a metal-oxide semiconductor (MOS) transistor serving as an analog switch for sampling a video signal and a holding capacitor for holding the sampled signal charge. The sampled data is subsequently provided to the pixel array via the data driver.

High resolution displays require wide bandwidth data channels. The bandwidth per channel can be reduced by increasing the number of input channels to a display. The minimum bandwidth for a given number of channels is achieved when the time allocated for providing data to each pixel in the pixel array equals the display refresh time divided by the number of pixels times the number of channels.

In a conventional LCD the display refresh time divided by the number of pixels is greater than the time allocated for providing data to each pixel. As a result, it is difficult to produce displays of higher resolution quality and a minimum channel bandwidth. Notwithstanding, there is a continuing need for a means for addressing a display organized into rows and columns such as a liquid crystal display.

SUMMARY OF THE INVENTION

The invention relates to a display driver including demultiplexing circuitry for providing a data signal from a data channel to upper and lower data lines. Also included is a sampling circuit for alternately sampling the data signal from the upper data line and the lower data line to produce and store a first sampled data signal and a second sampled data signal during a first and second time period respectively. The first sampled signal and the second sampled signal are retrieved by a data driver circuit during the second time period and the first time period respectively to create a transferring driving pulse corresponding to each of the first sampled data and the second sampled data. Each transfer pulse is provided to a pixel array.

According to another aspect of the invention, a data driver circuit is provided which has an output switch which is activated and deactivated so that non-linearity errors are eliminated.

BRIEF DESCRIPTION OF THE DRAWING

FIG. 8 is a waveform diagram which is useful for explaining the operation of the pointer register in FIG. 7;

FIG. 11 is a waveform diagram which is useful for explaining the operation of the select scanner circuitry;

DETAILED DESCRIPTION

Figure 1:
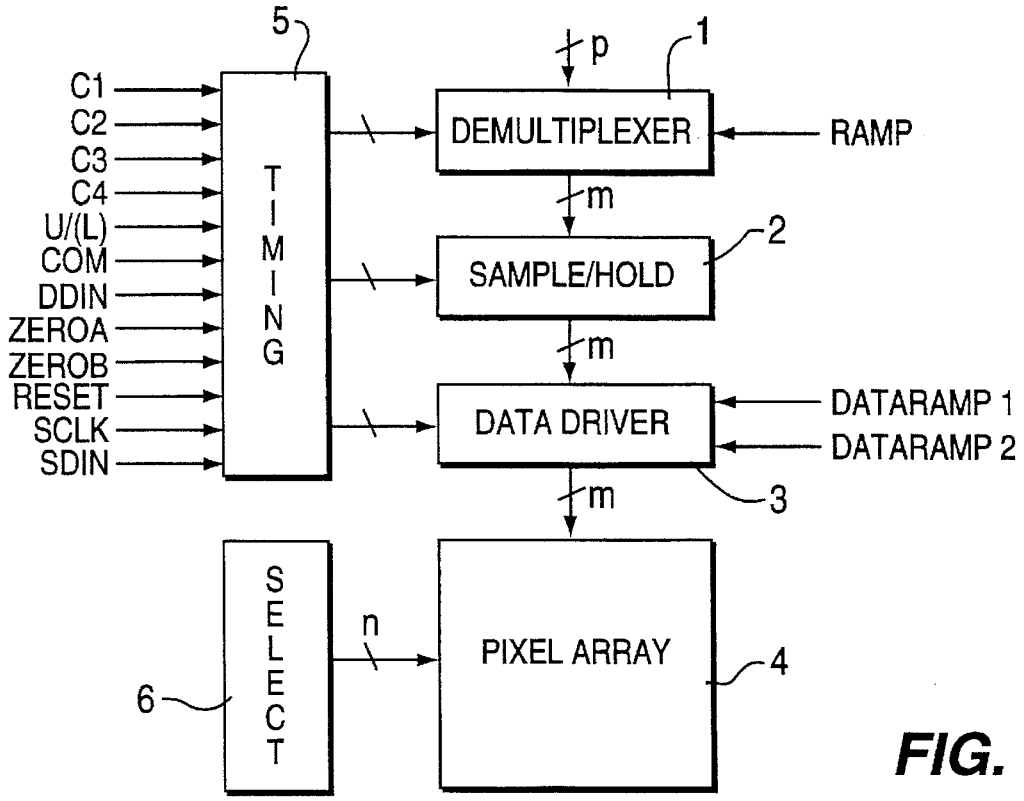
FIG. 1 is a block diagram of an LCD which includes an embodiment of the invention.

FIG. 1 is a block diagram for an LCD, for example a high resolution LCD, according to an exemplary embodiment of the invention which includes a demultiplexer circuit 1 coupled to a sample/hold circuit 2 which is in turn coupled to a data driver circuit 3. Timing circuitry 5 is coupled to each of the demultiplexer 1, sample/hold circuit 2, and data driver circuit 3. In addition, timing circuitry 5 is coupled to select scanner circuitry 6. Both the data driver 3 and the scanner circuitry 6 are coupled to a pixel array 4.

In operation, demultiplexer 1 is provided data signals, such as an analog or digital video signal, via P data channels which are demultiplexed to produce M data signals which are provided to sample/hold circuit 2 via data lines which correspond to the M columns of pixel array 4. The signals provided by the P data channels are in the range of zero volts to five volts. Sample/hold circuit 2 and data driver circuit 3 condition the data providing appropriate signals to the M columns of pixel array 4.

Sample/hold circuit 2 samples the M channels of demultiplexed data signals to produce M parallel data signals. Data driver circuit 3 receives the sampled signals and produces a corresponding driving pulse signal for each sampled signal which is provided to the M columns of the pixel array.

The driving pulse signals are provided to pixel array 4 a row at a time. Row access in the pixel array 4 is controlled by scanner circuitry 6. As M parallel driving pulses are provided to the pixel array 4, select scanner circuitry 6 selects one of the N rows of the pixel array to receive the M parallel pulses.

Timing circuitry 5 provides timing control signals to demultiplexer 1, sample/hold circuit 2, data driver 3 and select scanner circuitry 6 to coordinate demultiplexing, sampling, data driving and row selection for the pixel array.

FIGS. 2–13, described below, provide an expanded explanation of the LCD of FIG. 1.

Figure 2:
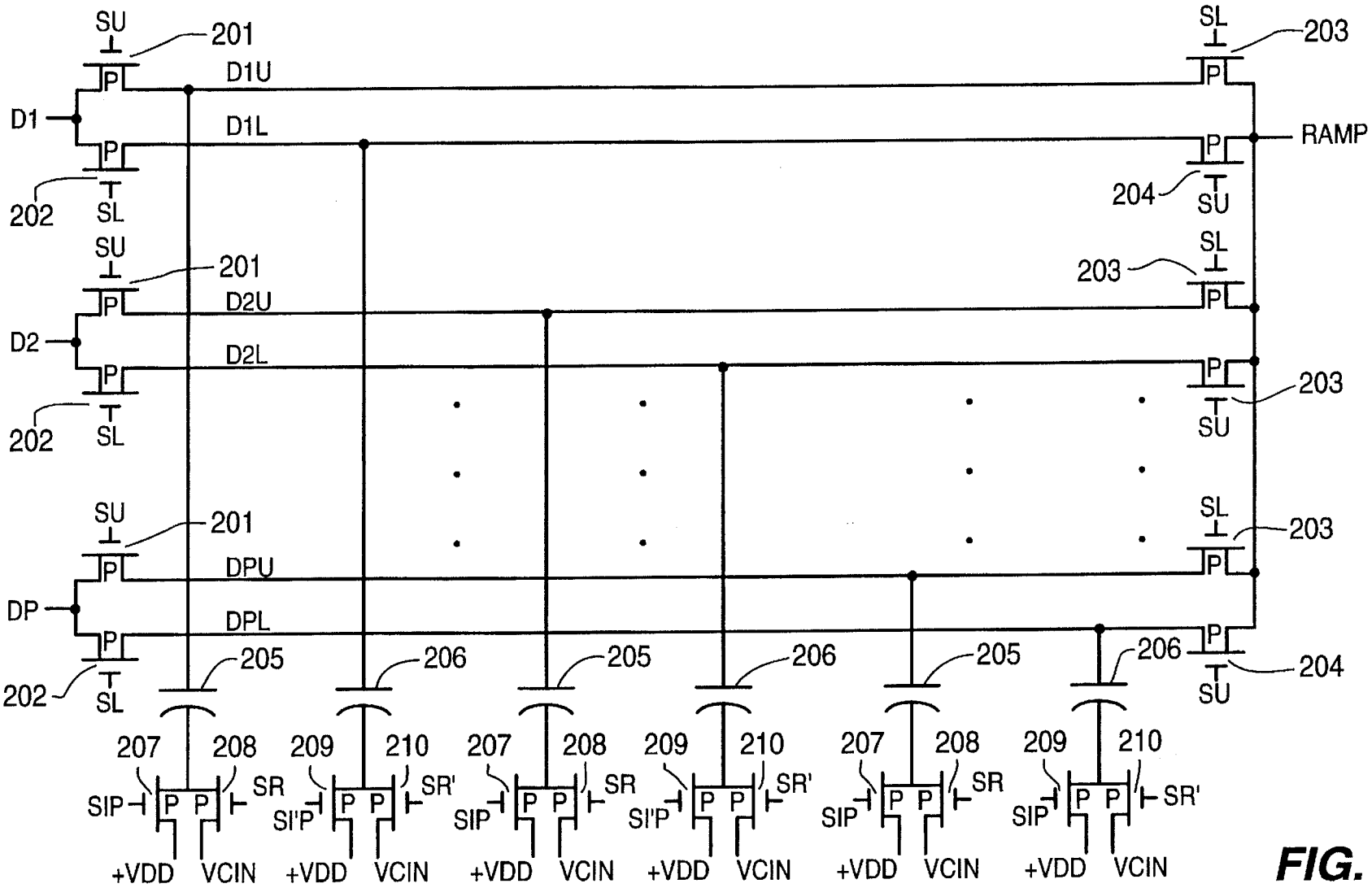
FIG. 2 is a circuit diagram of the demultiplexer and sample/hold circuits of FIG. 1 merged together at the transistor level according to the exemplary embodiment of the invention.

FIG. 2 shows exemplary circuits suitable for use as the demultiplexer 1 and sample/hold circuit 2 merged together at the transistor level. The merged demultiplexer and sample/hold circuitry alternately samples the data from a data channel using two sets of capacitors. Accordingly, one set of capacitors samples during a first period of time and the other set of capacitors samples during a second period time. As a result of time interleaving the sets of capacitors, it is possible to have one set of capacitors sampling an signal from a data channel while the other set provides its previously sampled signal from the same data channel to the data driver circuit. This ping-pong operation permits the maximum possible time for both sampling the signal and for driving the column line of the pixel array.

Analog signals are provided at data input channels D1 to DP from the P data channels. Input data channels D3 to DPM and their corresponding circuitry have been omitted from FIG. 2 for clarity and simplicity of explanation. In addition, the circuitry of FIG. 2 would be replicated for demultiplexing the P data channels to correspond with the M columns of the pixel array. For example, if pixel array 4 had 1280 columns, there would be 1280/P of the demultiplexing and sampling circuits of FIG. 2.

The merged demultiplexer 1 and sample/hold circuit 2 include pairs of PMOS transistors 201 and 202 having their source electrodes connected to a respective data channel D1 to DP. Each group of PMOS transistors 201, 202, 203, and 204 forms a channel demultiplexer.

There are P pairs of PMOS transistors 201 and 202 corresponding to each one of the P data channels D1 to DP. The drain electrode of each transistor 201 and 202 is coupled to a corresponding PMOS transistor 203 and 204. PMOS transistors 203 and 204 are in turn coupled to a ramp signal line RAMP. RAMP signal varies between –0.5 volts and 5.5 volts and is used to ramp the sampled signal from the data channels when the sampled signal is applied to the data driver circuit. The gates of the PMOS transistors 201 and 202 are supplied timing signals SU and SL respectively. PMOS transistors 203 and 204 are supplied respective timing signals SL and SU.

Coupled between PMOS transistors 201 and 203 is an upper line sampling circuit including capacitor 205 and transistors 207 and 208 and coupled between PMOS transistor 202 and 204 is the lower line sampling circuit. Capacitor 205 is coupled to the source electrodes of PMOS transistors 207 and 208 which have their drain electrodes coupled to +VDD and to data driver circuit 3 via sample signal VCIN.

Capacitor 206 and transistors 209 and 210 form the lower line sampling circuit. Capacitor 206 is coupled to the source electrodes of PMOS transistors 209 and 210 which have their drain electrodes respectively coupled to +VDD and to data driver circuit 3 via sample output VCIN.

Figures 4A, 4B, 4C, 4D, 4E, 4F, 4G, 4H, 4I, 4J, 4K, 4L, 4M:
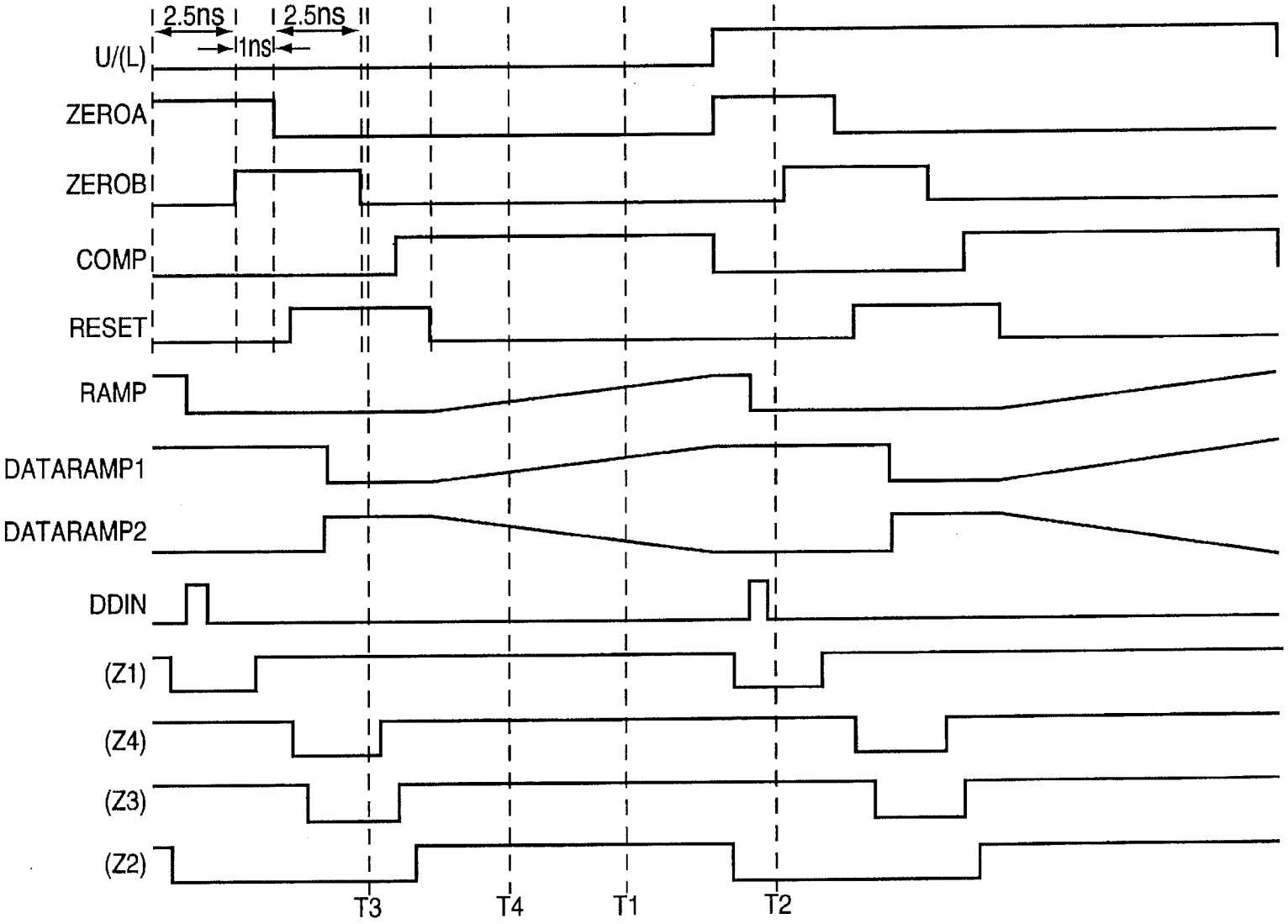
FIGS. 4A–4X are wave form diagrams useful for explaining the operation of the LCD of FIG. 1.
Figures 4N, 4O, 4P, 4Q, 4R, 4S, 4T, 4U, 4V, 4W, 4X:
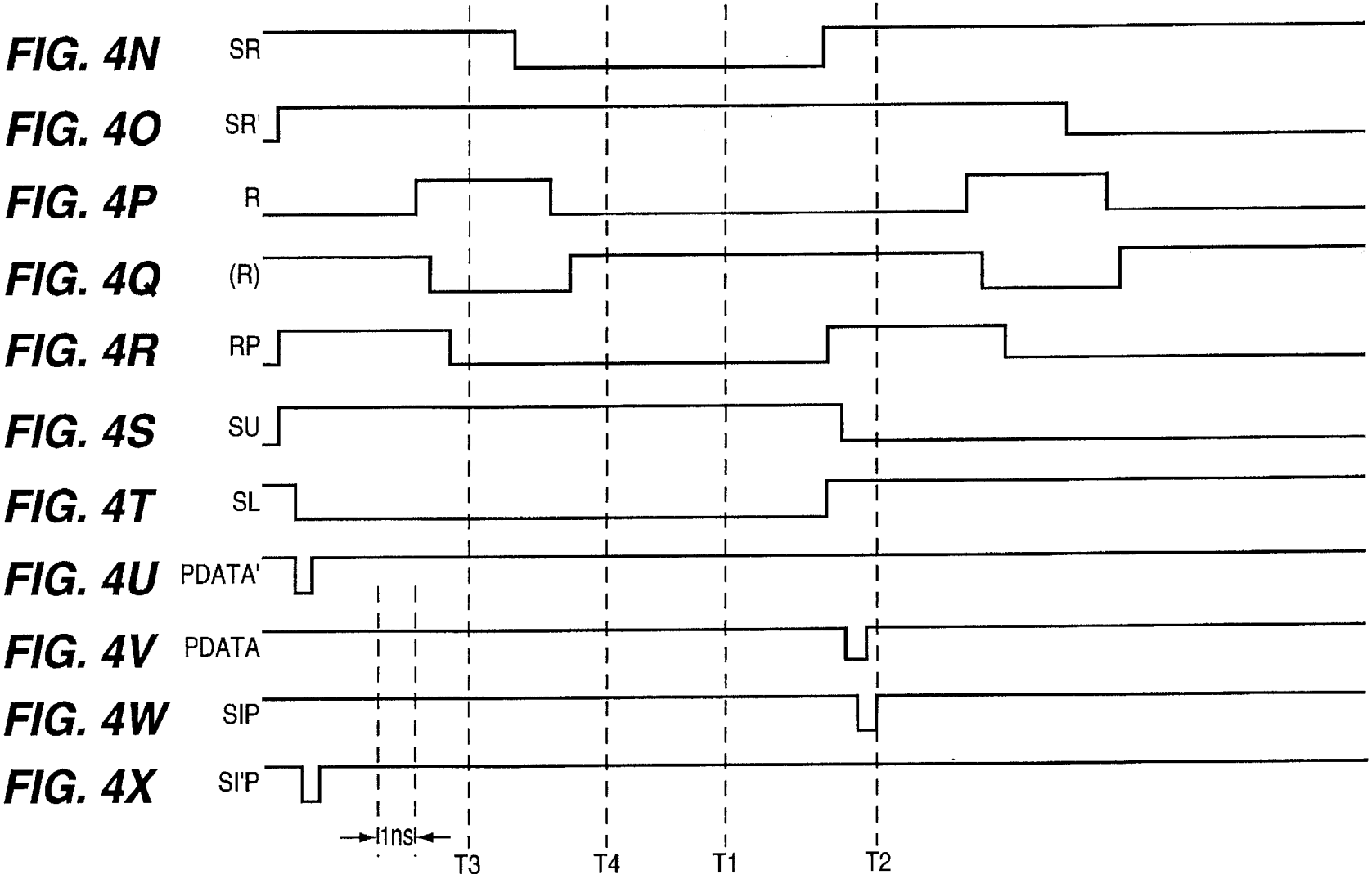
Figure 5A:
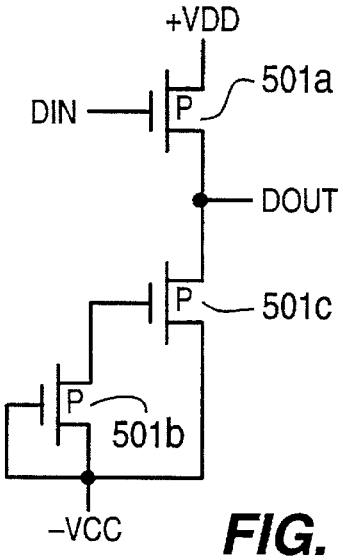
FIGS. 5*a*, 5*b*, 5*c*, 5*d*, and 5*e* are respective schematic diagrams for an inverter 703, an inverter 704, a NAND gate, a first level shifter, and a second level shifter suitable for use in the circuitry of FIG. 3.
Figure 5B:
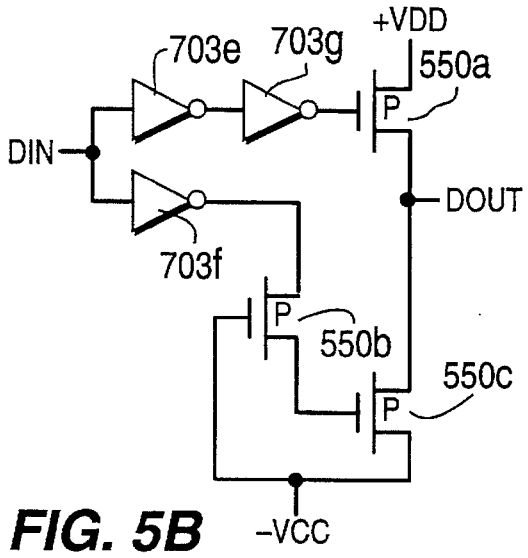
Figure 5C:
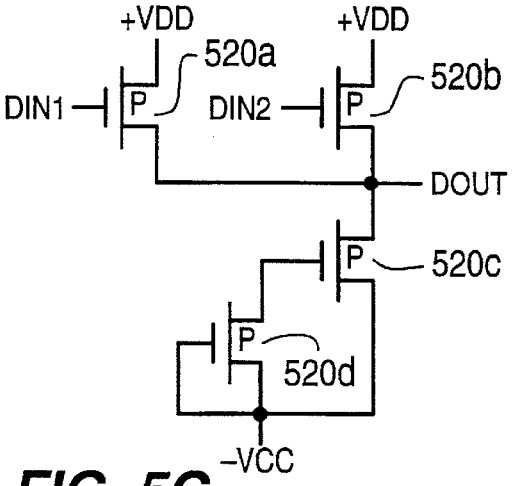
Figure 5D:
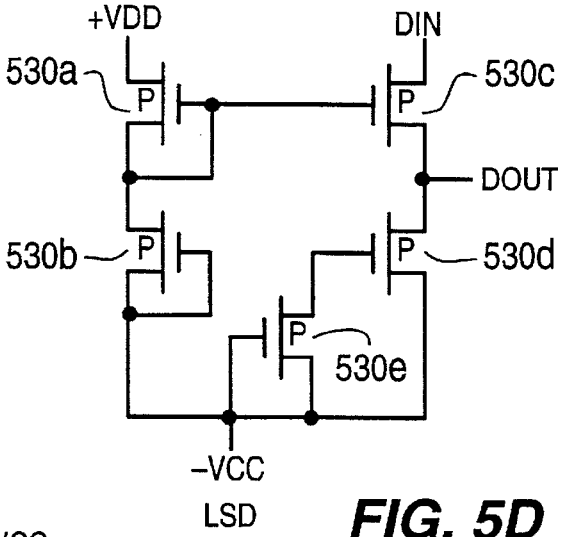
Figure 5E:
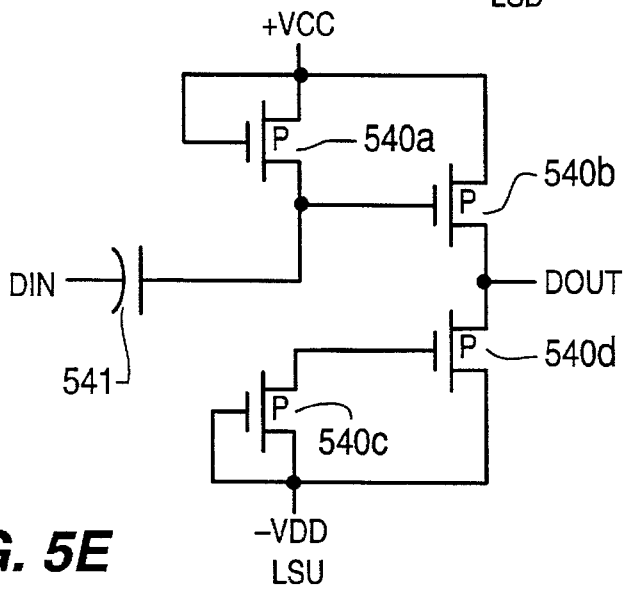

In operation, the P inputs D1 to DP are split into upper D1U to DPU and lower D1L to DPL data paths by transistors 201 and 202. This is accomplished by supplying timing signals SU and SL to transistors 201 and 202 respectively, in an alternating fashion as shown in FIGS. 4A–4X. As a result, transistors 201 and 202 are alternately activated. In addition, the RAMP signal is alternately supplied to (1) the upper data lines D1U to DPU and (2) the lower data lines D1L to DPL ramp, shown in FIG. 4F, when transistors 203 and 204 are alternately activated by respective timing signals SL and SU.

For example, at time T1 shown in FIGS. 4A–4X, transistor 202 has been activated by timing signal SL. Accordingly, the signal from channel D1 is provided to lower data line D1L. At substantially the same time, the ramp signal RAMP has been provided to the upper signal line D1U through transistor 203 which also has been activated by timing signal SL. Also at time T1, PMOS transistor 208 has been activated by timing signal SR so that capacitor 205 provides its previously sampled data from upper signal line D 1U to data driver circuit 3 via sample output terminal VCIN. The sampled data has the RAMP signal added to it when the sampled data is provided to the data driver circuit.

The continued operation of the merged demultiplexer 1 and the sample/hold circuit 2 is shown at time T2. At time T2, timing signal SU has applied a negative voltage to the gate electrode of PMOS transistor 201, thus, activating PMOS transistor 201. Also at time T2, timing signal SL has applied a positive voltage to the gate of PMOS transistor 202.

Capacitor 205 samples the signal on the upper data line D1U which corresponds to the signal from the first data channel D1. Capacitor 205 samples upper data line DiU when capacitor 205 is connected to +VDD by activation of PMOS transistor 207 by timing signal S1P. At time T2 Capacitor 205 has been disconnected from the data driver circuit by applying a positive voltage SR to the gate electrode of PMOS transistor 208.

Capacitor 206 samples the lower data line D1L when signal pulse S1'P activates PMOS transistor 209 connecting capacitor 206 to +VDD. The sampled data from capacitor 206 is provided to data driver circuit via sample output terminal VCIN by activating PMOS transistor 210 using timing signal SR'.

The remaining channel demultiplexers and upper and lower sampling line circuits for demultiplexing and sampling data channels D2 to DP operate in the same manner as the demultiplexer 1 and upper and lower sampling line circuits 2 for the first data channel D1. The lower sampling circuits provide sampled data from respective lower data lines DL to the data driver circuit at substantially the same time the upper sampling circuits sample the signals of respective upper data lines DU. In a like manner, upper sampling circuits provide sampled data from respective upper data lines DU to the data driver circuit at substantially the same time the lower sampling circuits sample the signals of respective lower data lines DL.

Timing signal U/(L), where "()" indicates an inverted signal, alternates between zero volts and five volts. Each change in timing signal U/(L) between zero and five volts corresponds to a new period for writing sampled data from the channels to a new row in the pixel array. The data, for example, may be alternately written to the pixel array alternating as even and odd rows of a video signal.

Accordingly, during first and second alternating time periods, one capacitor samples during the first time period and the other capacitor samples during the second time period. As a result of time interleaving capacitors 205 and 206 as described above, it is possible to have one capacitor sampling an signal from a data channel while the other capacitor provides its previously sampled signal from the same data channel to the data driver circuit 3. This permits the maximum possible time for both sampling the signal and for driving the column line of the pixel array 4.

Figure 3:
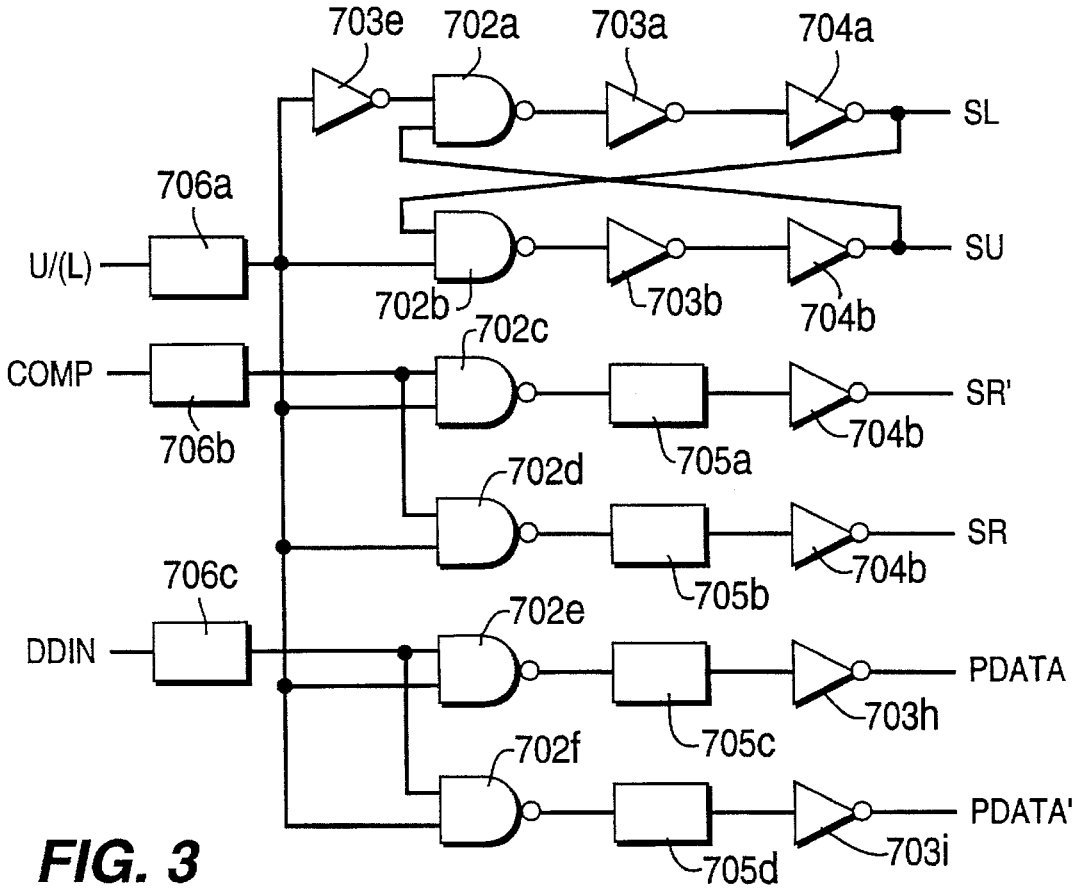
FIG. 3 is a logic diagram of the data scanning timing circuitry suitable for supplying timing signals to the merged demultiplexer and sample/hold circuits in shown FIG. 2.

FIG. 3 is a logic diagram for producing some of the timing signals shown in FIGS. 4A–4X. The logic shown in FIG. 3 is contained in timing circuit 5.

The U/(L) timing signal is coupled to level shifter 706*a* which is in turn coupled to inverter 703*e* and NAND gates 702*b* to 702*f* which varies from 0 to +5 volts. The level shifter shifts the voltage levels of the signal applied to the level shifter. The output of inverter 703*e* is provided to NAND gate 702*a*. NAND gates 702*a* and 702*b* form a cross coupled latch having inverters to delay transients. NAND gates 702*c* and 702*d* each receive an input from timing signal COMP through level shifter 706*b*. Timing signal COM varies between zero and five volts. NAND gates 702*e* and 702*f* are each provided with a timing signal DDIN through level shifter 706*c*. Timing signal DDIN varies between zero and five volts.

Each output of NAND gates 702*a* and 702*b* is provided to a respective inverter 703*a* and 703*b* which is in turn coupled to a respective inverter 704*a* and 704*b*. Each NAND gate 702*c* and 702*d* provides an output to a respective level shifter 705*a* and 705*b* which is in turn coupled to inverters 704*c* and 704*d* to produce timing signals SR' and SR respectively. NAND gates 702*e* and 702*f* each provide an output to a respective level shifter 705*c* and 705*d* which are in turn coupled to respective inverters 703*h* and 703*i* to produce timing signals PDATA and PDATA'.

In operation, timing signals SL, SU, SR, SR', PDATA, and PDATA' are produced in response to timing signals U/(L), COMP, and DDIN as shown in the wave form diagrams of FIGS. 4A–4X.

FIGS. 5*a*, 5*b*, 5*c*, 5*d*, and 5*e* are transistor level schematic diagrams for inverter 703, inverter 704, NAND gate 702, and level shifters 706 and 705. One of ordinary skill in the art, given the transistor level schematics shown in FIGS. 5*a*, 5*b*, 5*c*, 5*d*, and 5*e* would be able to make and use the inverter 703, inverter 704, NAND gate 702, and level shifters 706 and 705 shown in those figures. The voltage source ±VDD is plus or minus five volts (±15 v) and the voltage source ±VCC is plus or minus fifteen volts (±15 v).

Figure 6:
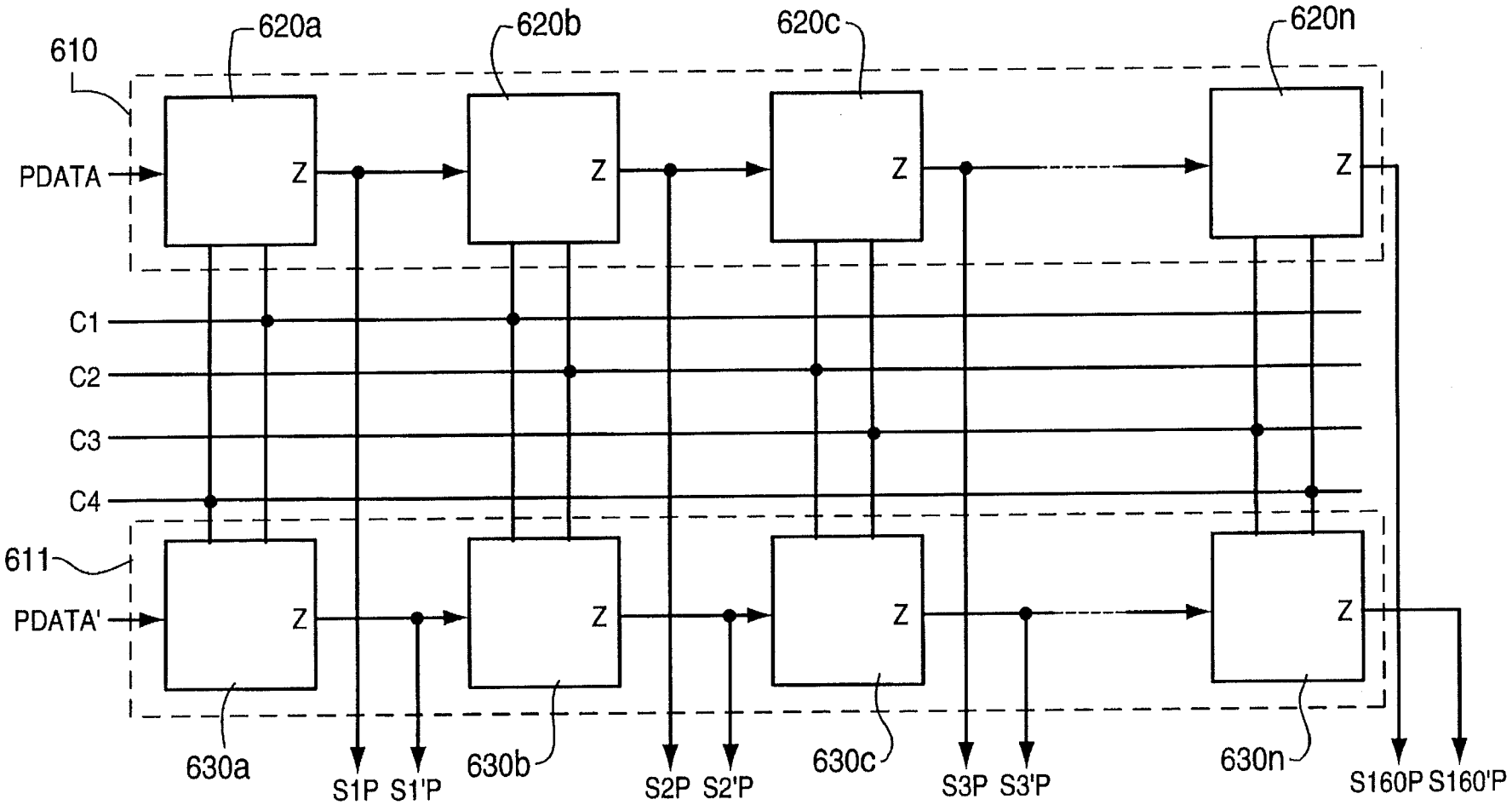
FIG. 6 is a block diagram of a pointer register for supplying sampling pulses to the merged demultiplexer and sample/hold circuitry of FIG. 2.

A pointer register, as shown in FIG. 6, is provided to generate timing signals S1P, S2P, S3P, . . . SnP and S1'P, S2'P, S3'P . . . Sn'P where n is a natural number. These timing signals are used to determine when the upper and lower line sampling circuits sample the P data channels. As described above, the upper and lower line sampling circuits are arranged in groups of P corresponding to the P data channels. By sequentially activating the groups of P line sampling circuits it is possible to demultiplex and sample the demultiplexed data signals provided by the data channels.

The signals S1P and S1'P are applied to each of the first group of P pairs of upper and lower sample line circuits which are in turn coupled to respective data channels D1 to DP. Signals S2P and S2'P are applied to each of the second group of P pairs of upper and lower sample line circuits which are in turn coupled to respective data channels D1 to DP. This process is repeated for each group of timing signals up to 1280/P and 1280/P if the pixel array 4 has 1280 columns. As a result, it is possible to sample signals from the data lines corresponding to the different columns of the pixel array.

The waveform diagram in FIG. 8 illustrates the timing for timing signals SIP, S2P, S3P, and S4P. Each timing signal is switched low 102 nanoseconds (ns) after the preceding timing signal has been switched low (102 ns implies 8 channels and 60 Hz operation). For example, at T0 in FIG. 8, S1P has been switched low to activate PMOS transistor 207 to sample the upper data line D1U to DPU. The next timing signal S2P is applied to the next group of PMOS transistors 207 102 ns to sample upper data lines D1U to DPU at time T1 shown in FIG. 8.

The pointer register includes groups of timing circuits 610 and 611 each of which includes N timing circuits 620 and 630 respectively, where N is a natural number. If, for example, the pixel array has 1280 column lines, then N would be 1280/P. The timing circuits 620 and 630 in each group 610 and 611 are coupled in series. For example, timing circuit 620*a* is coupled to 620*b* which is in turn coupled to 620*c*. In addition, each timing circuit 620 in group 610 is coupled to a corresponding timing circuit 630 of group 611. For example, timing circuit 620*a* of timing circuits 610 is coupled to timing circuit 630*a* of timing circuits 611 via two signal lines.

Each signal line coupled between each of the groups of timing circuits 610 and 611 is coupled to a respective timing signal C1, C2, C3, C4 from a four phase clock (not shown) for providing reference timing signals so that the timing signals S1P, S2P . . . are produced at the correct time in response to a output signal supplied from a previous timing circuit. Timing signals C1, C3 and C2, C4 from the four phase clock are break-before-make pairs and C1, C2, C3, and C4 alternate between negative five volts and positive fifteen volts.

Each signal line between timing circuits 620*a* and 630*a* is coupled to a respective timing signal line C1 or C4. Each signal line between timing circuits 620*b* and 630*b* is coupled to a respective timing signal line C1 or C2. Each signal line between timing circuits 620*c* and 630*c* is coupled to a respective timing signal line C2 or C3. Finally, each signal line between the next timing circuits (not shown) is coupled to a respective timing signal line C3 or C4. The above progression from C1 and C4 to C1 and C2 to C2 and C3 to C3 and C4 is repeated every four timing circuits to provide reference timing signals to the remaining timing circuits.

The first timing circuits 620*a* and 630*a* of each group receive timing signal input signals PDATA and PDATA' respectively. In response to the four phase clock and the PDATA and PDATA' timing signals the pointer register generates a sequence of output timing pulses, S1P, S1P', S2P, S2P'. . . These timing outputs are supplied from the output terminal Z of each timing circuit.

The timing diagram in FIG. 8 demonstrates the operation of the pointer register where DIN is either PDATA or PDATA'. The dashed lines shown in FIG. 8 indicate, for example, the generation of a new series of signal line outputs S1P to S4P produced in response to a change in the input signal DIN at a later point in time.

Figure 7:
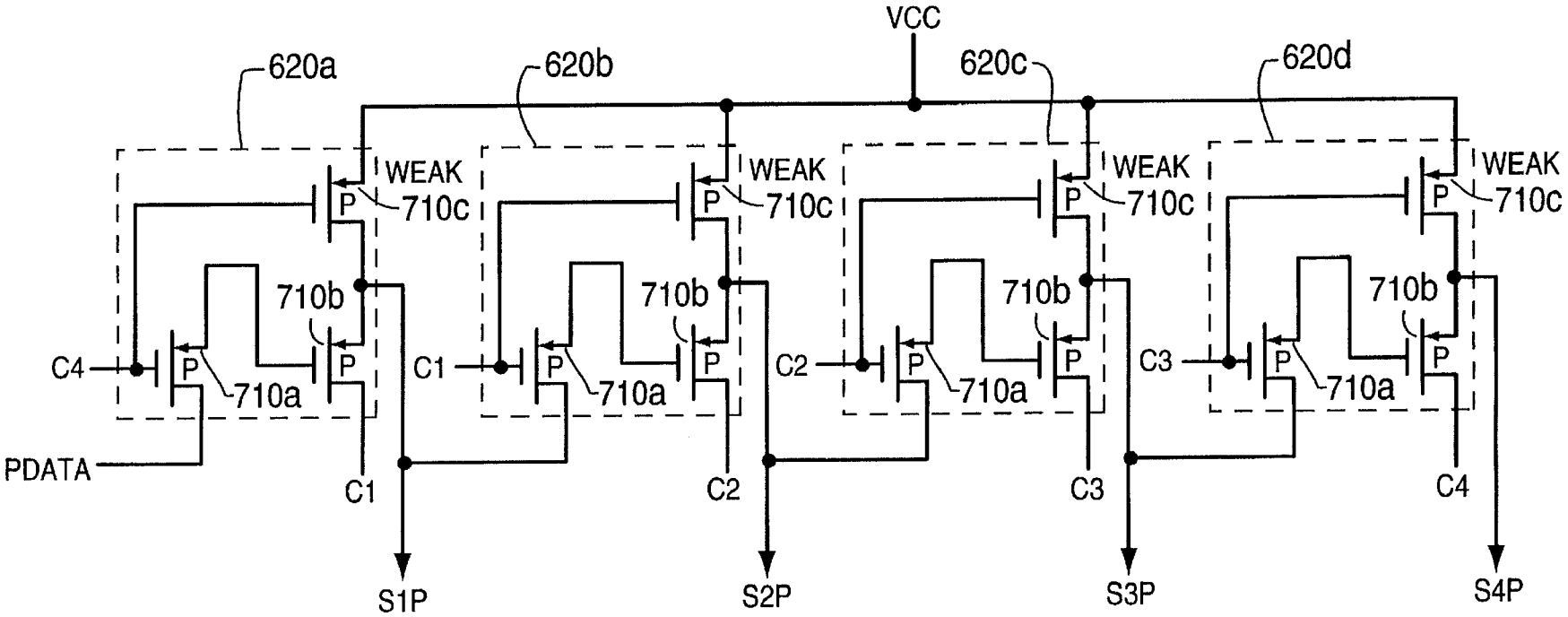
FIG. 7 is a schematic diagram of the pointer register of FIG. 6.

FIG. 7 shows the construction of the individual timing circuits 620 and 630 which are identified by the dashed boxes. The timing circuits 620 and 630 have the same construction, thus, the construction of the timing circuits will be explained with reference to the first four timing circuits 620*a*, 620*b*, 620*c*, and 620*d*.

Timing circuit 620*a* receives an input timing signal PDATA which is provided to the drain of PMOS transistor 710*a*. PMOS transistor 710*a* also receives timing signal C4 at its gate which is also provided to the gate of PMOS transistor 710*c*.

The source of PMOS transistor 710*a* is coupled to the gate of PMOS transistor 710*b*. The drain of PMOS transistor 710*b* is coupled to timing signal C1 and the source is coupled to the drain of PMOS transistor 710*c* which is also coupled to the output signal line S1P. The source of PMOS transistor 720*c* is coupled to VCC.

PMOS transistors 710*c* have a narrow channel relative to the devices that these are in series with. As a consequence, for a given gate to source voltage, PMOS transistor 710*c* would conduct less current. Accordingly, if PMOS transistors 710*c* and 710*b* are both activated, PMOS transistor 710*b* would dominate the node common to the transistors. Thus, if PMOS transistor 710*b* is pulling down because a negative five volt timing signal C1 level is applied to its drain, the node will be pulled down in voltage by PMOS transistor 710*b*. As a result, timing signal S1P switches to a negative voltage.

The construction of the remaining timing circuits are the same except that the timing signals C provided to the gate of PMOS transistors 710*a* and 710*c* and to the drain of PMOS transistor 710*b* are coupled to different timing signals C and the drain of PMOS transistor 710*a* is coupled to the output signal line Z of the previous timing circuit.

For example, timing circuit 620*b* has the gate of PMOS transistors 710*a* and 710*c* coupled to timing signal line C1 and the drain of PMOS transistor 710*b* coupled to the timing signal line C2. In addition, the drain of PMOS transistor 710*a* is coupled to output timing signal line S1P provided by timing circuit 620*a*.

The next timing circuit 620*c* has the gate of PMOS transistors 710*a* and 710*c* coupled to timing signal line C2 and the drain of PMOS transistor 710*b* coupled to timing signal line C3. In addition, the drain of PMOS transistor 710*a* is coupled to output timing signal line S2P provided by timing circuit 620*b*.

The next timing circuit 620*d* has the gate of PMOS transistor 710*a* and 710*c* coupled to timing signal line C3 and the drain of PMOS transistor 710*b* is coupled to timing signal line C4. In addition, the drain of PMOS transistor 710*a* is coupled to output timing signal line S3P provided by timing circuit 620*c*.

The configuration for timing circuits 620*a*, 620*b*, 620*c* and 620*d* is repeated every four timing circuits except that PDATA and PDATA' are only provided to timing circuits 620*a* in groups 610 and 611. The remaining timing circuits are provided the output signal SP from a preceding timing circuit to the drain of PMOS transistor 710*a*.

Figure 9:
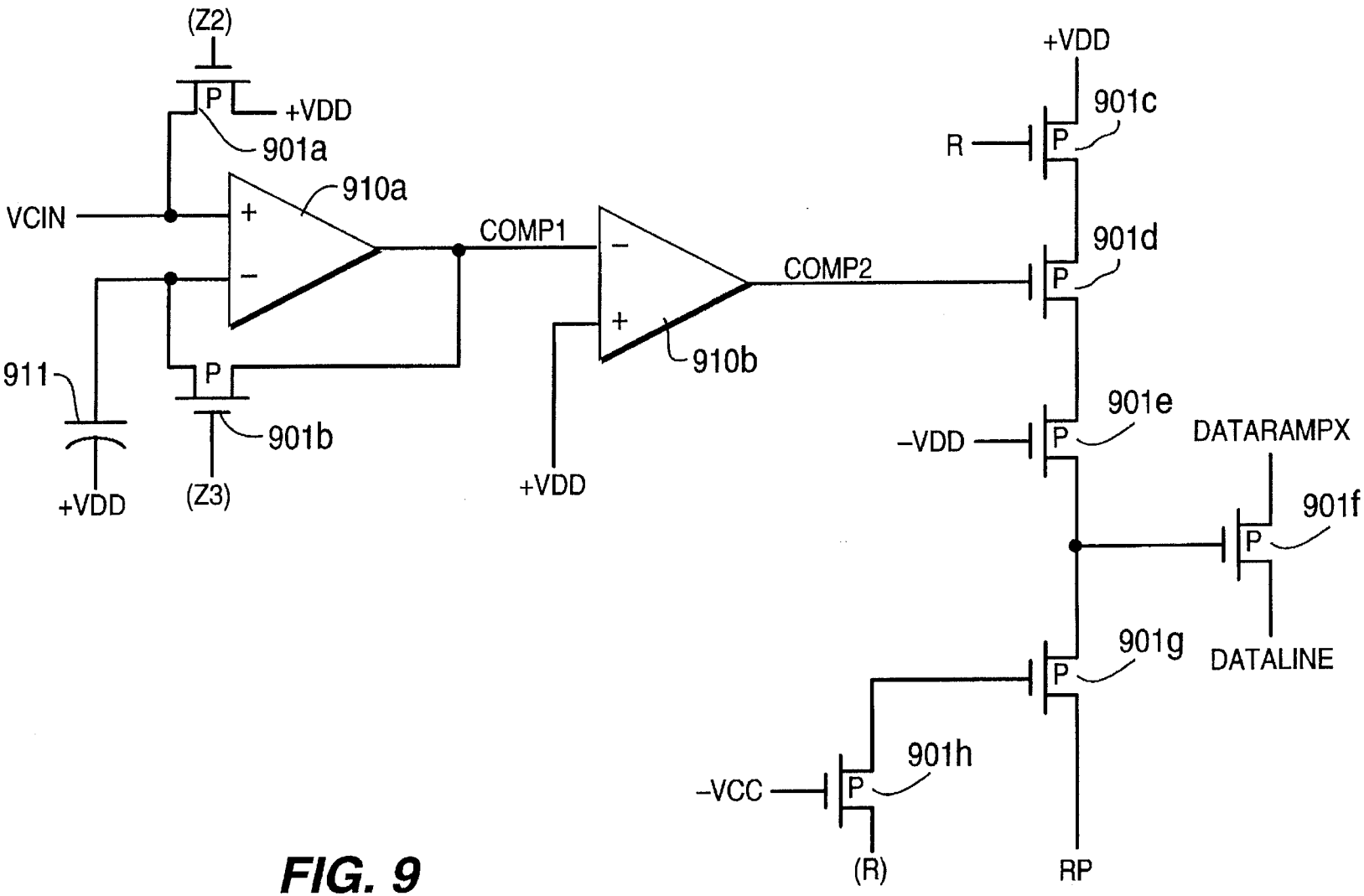
FIG. 9 is a circuit diagram for a data driver in accordance with an exemplary embodiment of the invention.

The output signal from sample/hold circuit 2 is provided to data driver circuit 3. Each column of the pixel array has a corresponding data driver as shown in FIG. 9 for providing a driving pulse. The data driver is constructed so that errors introduced by the output transistor appear as an offset rather than a nonlinearity.

One problem with conventional data driver circuitry implemented in MOS technology is that the impedance of the column transistor varies as the source to gate voltage as occurs in the operation of devices such as those described herein where a ramp voltage signal is applied to the source of the transistor.

The exemplary embodiment of the invention eliminates impedance variations, and therefore signal non-linearities by floating the gate of the column transistor after it has been initially set at approximately −VCC. As a result, non-linearities are eliminated because $V_{GS}$ remains constant when a ramp signal is applied to the source electrode of a column transistor.

The data driver includes an output PMOS transistor 901*f* having its source coupled to a data ramp and its drain coupled to an output signal DATALINE of the data driver coupled to a column of the pixel array 4. After the gate of PMOS transistor 901*f* is set to a voltage level, −VCC, the gate is left floating by applying a high impedance to the gate. Then, a ramp signal is applied to the source of the transistor. The signal level of the data line follows the ramp signal as long as the column transistor is activated. The signal level of the data line is determined by the inactivation of the column transistor. The column transistor is inactivated at a point in time determined by the sampled signal.

By floating the gate an error introduced by the output transistor is prevented from appearing as a non-linearity. The errors produced will appear as an offset error which is easily corrected.

The data driver in FIG. 9 includes a comparator 910 coupled to VCIN at its positive input terminal and to +VDD through capacitor 911 at its negative input terminal. The positive and negative input ports are also coupled to the source of PMOS transistors 901*a* and 901*b*. The drain of PMOS transistor 901*a* is coupled to +VDD and the drain of PMOS transistor 901*b* is coupled to the output terminal COMP1 of comparator 910*a*. The gates of PMOS transistors 901*a* and 901*b* are coupled to timing signals (Z2) and (Z3) respectively, where "()" identifies an inverted signal.

Comparator 910*a* provides comparator signal COMP1 to the negative input terminal of a second comparator 910*b*. The positive input terminal of comparator 910*b* is coupled to +VDD. The output terminal of comparator 901*b* provides a comparator signal COMP2 to the gate of PMOS transistor 901*d*. The source of the PMOS transistor 901*d* is coupled to the drain of PMOS transistor 901*c*. The gate of PMOS transistor 901*c* is supplied a timing signal R and its source is coupled to +VDD. The drain of PMOS transistor 901*d* is coupled to the source of PMOS transistor 901*e* and to the gate of PMOS transistor 901*f*. The gate of PMOS transistor 901*e* is coupled to −VDD. The drain of PMOS transistor 901*g* is coupled to RP and its gate is coupled to the source of PMOS transistor 901*h*. The source of PMOS transistor 901*h* is coupled to (R) and its gate is coupled to −VCC. The source of column PMOS transistor 901*f* is coupled to a ramp signal DATARAMPX and its drain is coupled to the column data line DATALINE for driving a corresponding column of pixel array 4. The ramp signal DATARAMPX varies between minus one (−1) volt and minus one (−1) volt plus or minus six (−6) volts.

The operation of the data driver may be broken into two time periods including an initialization period and an operational period. During the initialization period, the data driver circuitry is initialized and during the operational period, the data driver applies a signal to the pixel array.

During the initialization period, at time T3 shown in FIGS. 4A–4X PMOS transistor 901*c* is turned off because the timing signal R is +VDD. As a result, a comparator signal COMP2 supplied by comparator 901*b* has no effect on the signal output DATALINE supplied by the data driver.

In addition, at time T3, timing signal (R), where () indicates an inverted timing signal R, is –VCC. –VCC is minus fifteen (–15) volts. As a result, the gate of PMOS transistor 901*g* is drawn to within a threshold of –VCC. As the gate of PMOS transistor 901*g* moves towards –VCC, PMOS transistor 901*b* is turned off floating the gate of PMOS transistor 901*g*.

Then, when RP is –VCC, the potential at the source of PMOS transistor 901*h* lowers which allows the gate of PMOS transistor 901*g* to go below –VCC. As a result, the potential at the source of PMOS transistor 901*g* becomes –VCC. As a result, –VCC is applied to the gate of PMOS transistor 901*f* which creates a maximum gate to source voltage on PMOS transistor 901*f*.

During the operational period, at time T4 shown in FIGS. 4A–4X timing signal (R) is +VDD. Accordingly, PMOS transistor 901*h* is activated which, in turn, turns off PMOS transistor 901*g* leaving the gate of the column transistor 901*f* floating. At this time, timing signal R is –VCC which activates PMOS transistor 901*c* allowing the column transistor to respond to the comparator 910*b*.

During the period when the gate of the column transistor 901*f* is floating at a potential of –VCC, the compared signal COMP2 supplied by comparator 910*b* turns off PMOS transistor 901*d*. PMOS transistor 901*e* is used to limit the drain to source voltage of PMOS transistor 901*d*. As a result, leakage current from the transistor 901*d* into the floating node is substantially reduced so that the maximum gate to source voltage of PMOS transistor 901*f* can be maintained.

The comparators 901*a* and 901*b* are initially set so that the compared signal COMP2 turns off transistor 901*d* so that the gate of the column transistor floats at approximately –VCC. When the ramp signal DATARAMPX is applied to the source of column transistor 901*f*, the gate to source voltage remains substantially constant whether the DATARAMP signal increases or decrease in voltage level.

When the comparator responds to the sampled signal VCIN, the compared signal COMP2 activates PMOS transistor 901*d*. As a result, a positive voltage is applied to the gate of the column transistor 901*f* causing the column transistor to turn off separating the column line of the pixel array from the ramp signal DATARAMPX.

Although FIG. 9 includes two comparators, the data driver shown in FIG. 9 may be implemented using one comparator.

Figure 10:
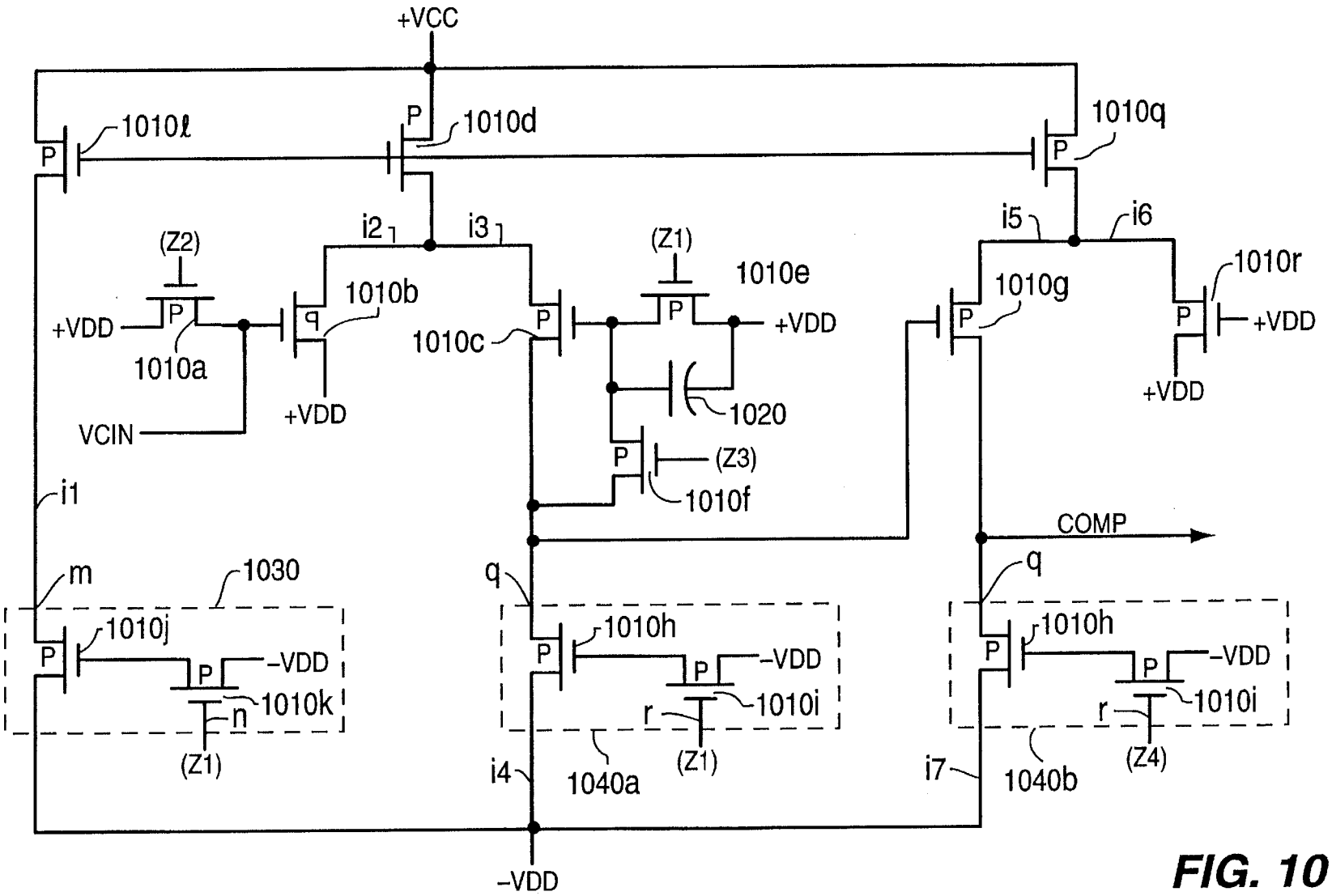
FIG. 10 is a transistor level schematic diagram of the comparator of FIG. 9.
Figure 12A:
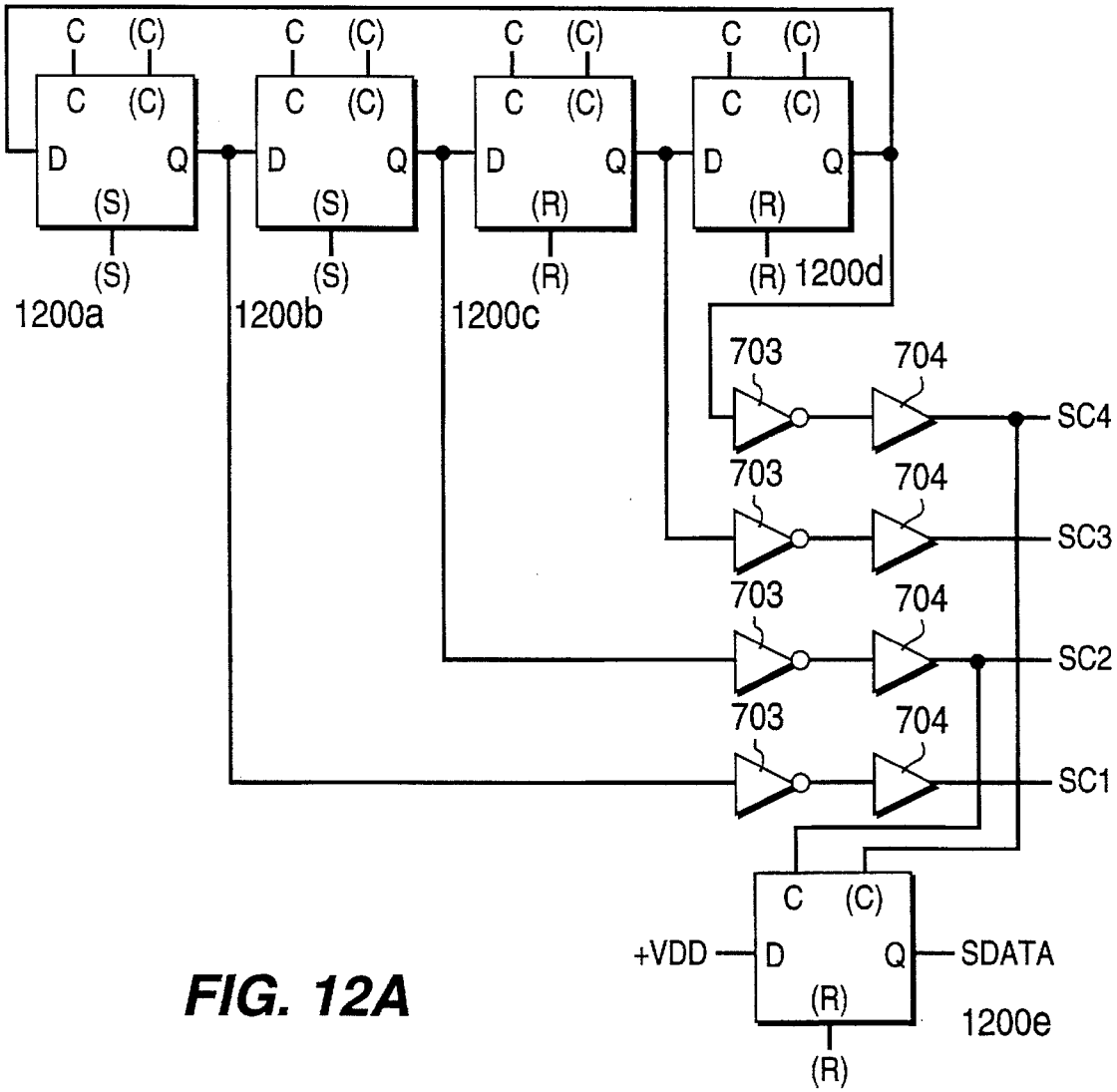
FIGS. 12*a* and 12*b* are logic diagrams of exemplary circuits for producing the timing wave forms in FIG. 11.
Figure 12B:
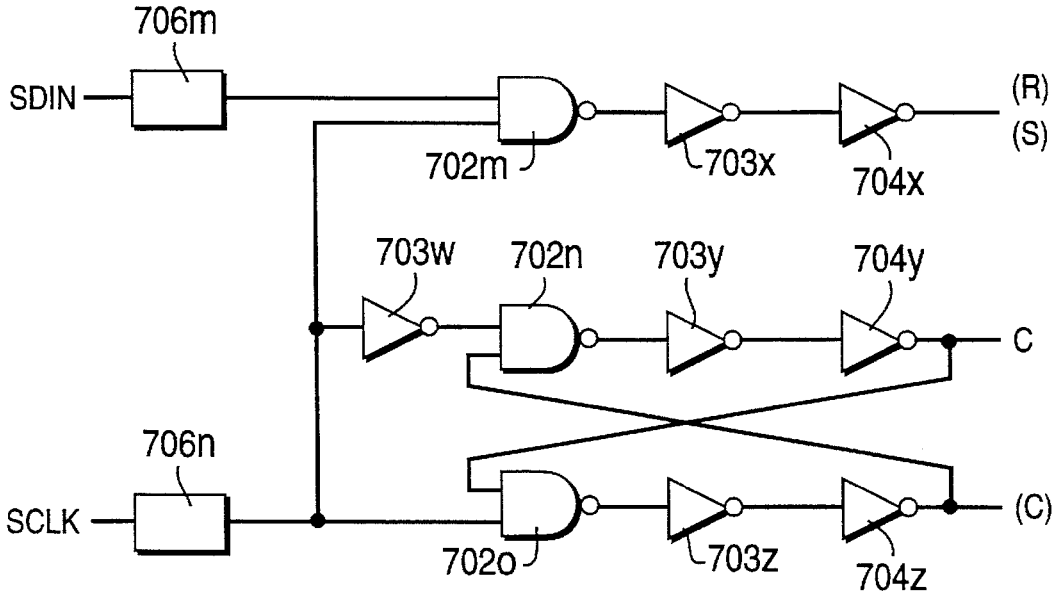
Figure 14A:
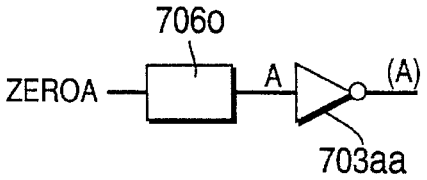
FIGS. 14*a*–14*e* are the logic diagrams, partly in block diagram form, of circuits for generating the timing signals for the data driver circuit of FIG. 9.
Figure 14B:
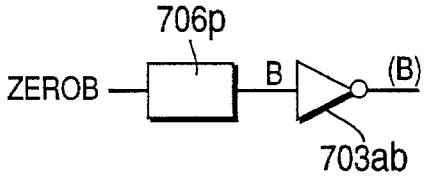

The combined transistor level schematic of the comparators 910 are shown in FIG. 10. PMOS transistors 1010*b* and 1010*c* form a differential pair. The gate of PMOS transistor 1010*b* is coupled to VCIN and +VDD through PMOS transistor 1010*a*. The gate of PMOS transistor 1010*a* is coupled to timing signal (Z2). PMOS transistor 1010*b* also has its drain coupled to +VDD. Coupled to the common source electrodes of the differential pair is PMOS transistor 1010*d*. PMOS transistor 1010*c* has its drain coupled to the drain of PMOS transistor 1010*f*, the gate of PMOS transistor 1010*g* and the q terminal of current load 1040*a*. The gate of PMOS transistor 1010*c* is coupled to +VDD through PMOS transistor 1010*e* and capacitor 1020 and to the source of PMOS transistor 1010*f*. The gates of PMOS transistors 1010*e* and 1010*f* are coupled respectively to timing signals (Z1) and (Z3).

PMOS transistors 1010*g* and 1010*r* form a second differential pair. Coupled to the common source electrode of the second differential pair is PMOS transistor 1010*q*. The gate and drain of PMOS transistor 1010*r* is coupled to +VDD. PMOS transistor 1010*g* has its drain coupled to the output signal COMP2 provided by the comparator 901*b* and to the q terminal of current load 1040*b*.

PMOS transistor 1010*h* and 1010*i* form current load 1040. The source of PMOS transistor 1010*h* is the q terminal and the gate of transistor 1010*i* is the r terminal of current sink 1040. The gate of PMOS transistor 1010*h* is coupled to –VDD through PMOS transistor 1010*i* and the drains of PMOS transistors are coupled to –VDD.

The q terminal of current load 1040*a* is coupled to the gate of PMOS transistor 1010*g* and to the devices 1010*c* and 1010*f*. The r terminal of current load 1040*a* is coupled to (Z1). The q terminal of current load 1040*b* is coupled to the drain of PMOS transistor 1010*g* and to the comparator signal COMP2 of the comparator. The r terminal of current 1040 is coupled to timing signal (Z4).

PMOS transistor 1010*j* and 1010*k* form current sink 1030. The source of PMOS transistor 1010*k* is the M terminal which is coupled to the drain and source of PMOS transistor 10101 and the gate of transistor 1010*i* is the N terminal which is coupled to –VDD.

PMOS transistors 1010*d* and 1010*q* are current sources for the first and second differential pairs, respectively, mirroring the current which flows through PMOS transistor 10101. This current is determined by the current sink 1030. The sources of PMOS transistors 1010*l*, 1010*d*, and 1010*q* are coupled to +VCC. The gate of PMOS transistors 1010*l*, 1010*d*, and 1010*q* are coupled to each other as well as to the drain of PMOS transistor 1010*l*.

In operation, for current sink 1030, when timing signal (Z1) is –VCC, PMOS transistor 1010*k* is activated and as a result, –VDD is applied to the gate of PMOS transistor 1010*j*. Accordingly, a current i1 flows through PMOS transistor 1010*j*. The current i1 is determined by the difference between +VCC and –VDD and the impedance level of the PMOS transistors. When timing signal (Z1) becomes +VDD, PMOS transistor 1010*i* is inactivated and the gate of PMOS transistor 1010*h* floats. As a result, the current i1 remains substantially constant because the gate to source voltage of PMOS transistor 1010*j* remains constant.

The gate voltage follows the source voltage because of the capacitance which exists between the gate and the source. As a result, current sink 1030 has a substantially constant current which does not change beyond a first order of magnitude. The gate will follow the source as long as the gate to source capacitance is greater than any parasitic capacitance between the gate and any other electrode.

The current which flows through PMOS transistor 1010*j* also flows through PMOS transistor 1010*l*. This current is mirrored into the current sources 1010*d* and 1010*g* for the two differential stages. This occurs because the gate to source voltage for PMOS transistors 1010*l* and 1010*d* and 1010*q* are the same. When timing signal (Z1) is +VDD, timing signal (Z2) is –VDD so that the inputs to the differential stages are both coupled to +VDD. The first differential pair takes the current flowing from current source 1010*d* and splits it in half so that one half of the current i2, flows through PMOS transistor 1010*b* and the other half of the current, i3, flows through PMOS transistor 1010*c*.

Current i3 flows through current load 1030*a*. When timing signal (Z1) is +VDD, the gate of PMOS transistor 1010*h* floats. As a result, a constant current i3 is drawn by the current load 1040*a*.

The second differential pair takes the current flowing from current source 1010*q* and splits it in half so that half of the current i5 flows through PMOS transistor 1010*g* and half of the current i6 flows through PMOS transistor 1010*r*. When timing signal (Z4) is −VCC, current load 1040*b* is set to draw the current i5. However, to ensure that the current is appropriately initialized, timing signal (Z3) is made −VDD first, tying the gate and drain of PMOS transistor 1010*c* together. As a result, the first differential pair seeks a point where its output is approximately +VDD. Accordingly, +VDD is applied to the gates of the second differential pair.

The current provided by current source 1010*q* is equally split to flow down both sides of the differential pair. Thus, current load 1040*b* can be initialized with a current i5. When timing signal (Z4) is +VDD, the current flowing through the current load transistor is set at a constant level in the same manner as current load 1040*a*.

Setting the current sources and the current loads above is an initialization process which occurs in a period of approximately 1280/60 micro seconds. The time for applying one row of pixel data to the pixel array is approximately sixteen micro seconds. The initialization process occurs in the first 1280/60 microseconds.

When initialization of the comparator is complete, timing signals (Z1), (Z2), (Z3) and (Z4) are +VDD, +VCC, +VCC, and +VDD respectively. At this time, the comparator 910*a* or 910*b* appear as two differential pairs with current source loads. Thus, the comparators are ready to receive the sampled signal VCIN.

Alternatively, the circuits of FIGS. 9 and 10 might be fabricated using a single comparator 910*a*, eliminating the comparator 910*b* and inverting the polarities of the input signals to comparator 910*a*.

The data provided to each column by the data driver circuit is selected for a particular row in accordance with the select scanner circuitry. The select scanner is controlled by four D flip-flops 1200*a* to 1200*d* coupled in series, inverters 703, inverters 704 and a final D flip-flop 1200*e*. Inverter 703 and inverter 704 in FIG. 12*a* refer to like numbered logic circuits which have been referred to in other figures using the same reference numerals. The input signals (S) and (R) are asynchronous inverted set and reset and input signals C and (C) are clock signals generated by the logic circuit shown in FIG. 12*b*. Timing input signals SDIN and SCLK vary between zero and five volts.

Figure 13:
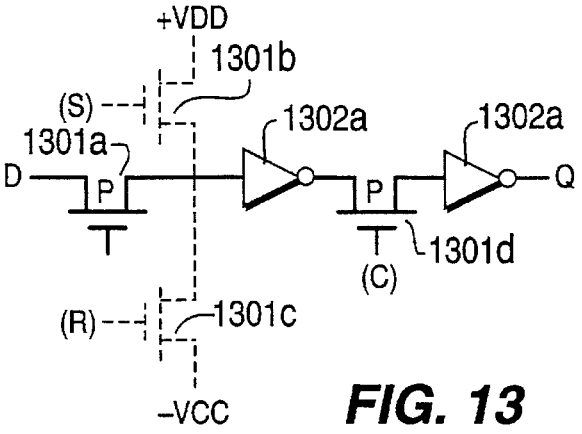
FIG. 13 is a circuit diagram for the D flip-flop of FIG. 12.
Figure 14C:
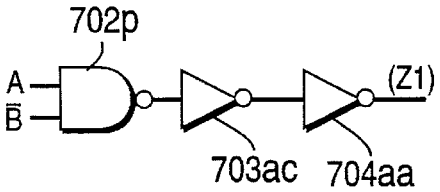
Figure 14D:
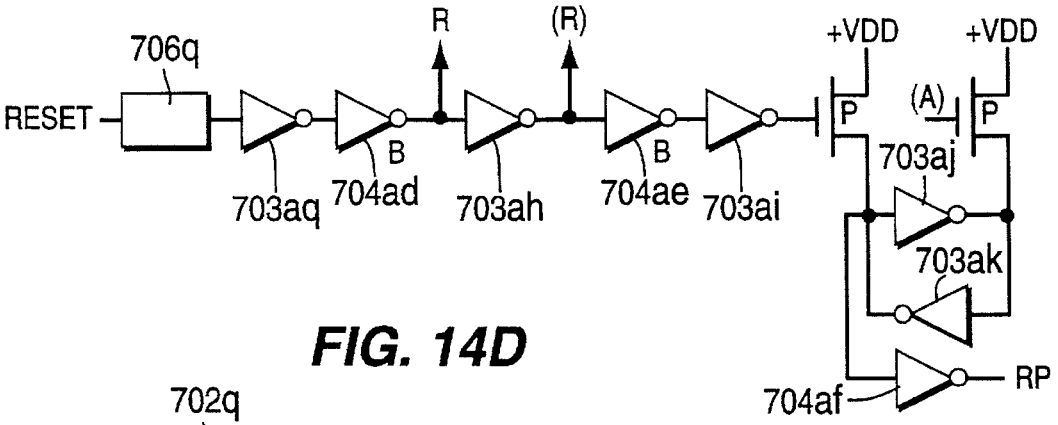
Figure 14E:
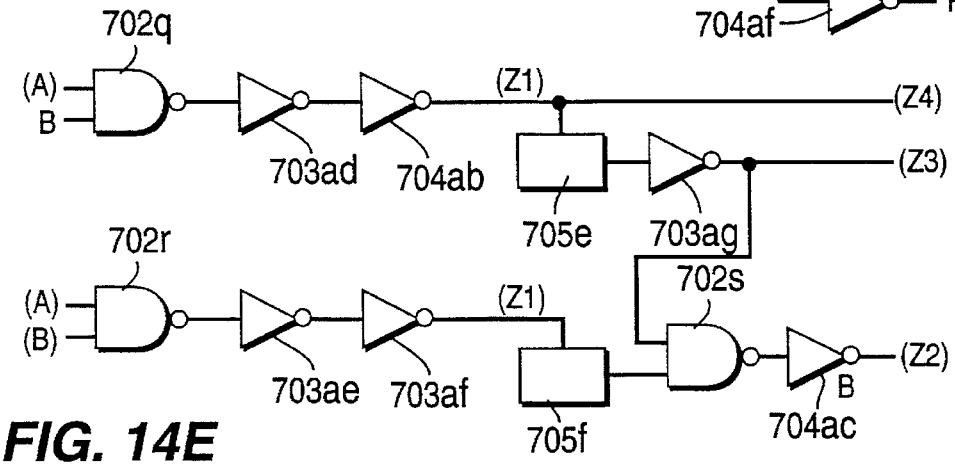

The D flip-flop 1200 is constructed as shown in FIG. 13. The D flip-flop includes the drain of PMOS transistor 1301*d* coupled to input terminal D and its gate coupled to input terminal C. The source of PMOS transistor 1301*a* is coupled to inverter 1302*a*. Inverter 1302 is the same as inverter 703. Depending on the D flip-flop, whether it receives timing signals (S) or (R), the drain of PMOS transistor 1301*a* is also coupled to the source of PMOS transistor 1301*c* or to the drain of PMOS transistor 1301*b*. The drain of PMOS transistor 1301*c* is connected to −VCC and the gate is connected to (R). The source of PMOS transistor 1301*b* is connected to +VDD and its gate is connected to (S). The output of inverter 1302*a* is coupled to the source of PMOS transistor 1301*d* which has its gate coupled to (C) and its drain coupled to inverter 1302*a* which provides an output signal at terminal Q.

The logic diagrams in FIGS. 14*a*–14*e* show the logic circuits for generating the timing signals for the data driver circuit in FIG. 9. LSD 706, LSU 705, NAND 702, inverter 703, and inverter 704 in FIGS. 14*a*–14*e* refer to like numbered logic circuits which have been referred to in other figures using the same reference numerals. ZEROA, ZEROB, and RESET vary between zero volts and five volts.

Figure 15:
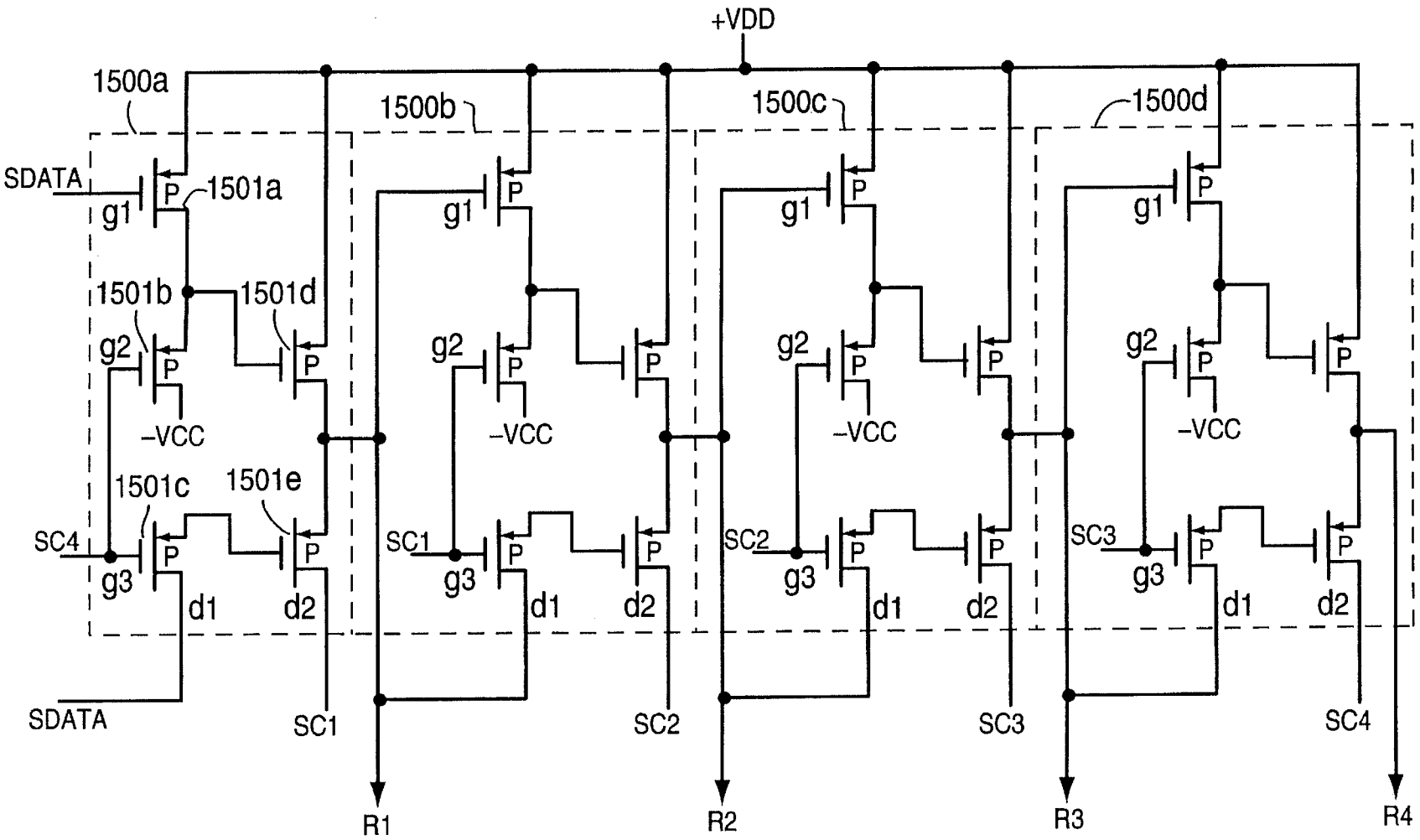
FIG. 15 is a transistor level schematic diagram for the select scanner circuitry of FIG. 1.

The select scanner circuitry is shown in FIG. 15 constructed of PMOS transistors.

One of ordinary skill in the art, given FIGS. 12*a*, 12*b*, 13, 14*a*–14*e* and 15, would be ale to make and use the logic devices shown in those figures.

In addition, although the circuitry shown in the figures is implemented using only PMOS transistors, those skilled in the art would be able to substitute other types of transistor technologies to implement the exemplary embodiments. However, by using only PMOS transistor technology, the data driver circuitry is easier to manufacture and may be produced at a lower cost. In conventional LCDs CMOS technology is used. However, the NMOS devices are difficult to make, thus, making it more difficult to manufacture and raising the costs of the LCDs.

Although illustrated and described herein with reference to certain specific embodiments, the invention is nevertheless not intended to be limited to the details shown. For example, the invention is applicable to any display where data is read into a line of a display organized in rows and columns, such as an active matrix electroluminescent display. Rather, various modifications may be made in the details within the scope and range of equivalents of the claims and without departing from the spirit of the invention.

I claim:

1. A data driver for a display, the data driver comprising:

means for providing a data signal from a data channel to a first data line and a second data line;

sample means for alternately sampling the data signal (1) from the first data line to produce and store a first sampled data signal during a first time period and (2) from the second data line to produce and store a second sampled signal during a second time period; and data driver means for retrieving from the sample means, the first sample data signal during the second time period and the second sampled data signal during the first time period and for transferring a driving pulse corresponding to one of the first sampled data signal and the second sampled data signal to the display.

2. The driver of claim 1, wherein the data driver means includes switching means having a conductive path between a first electrode and a second electrode, the switching means also having a third electrode for receiving a control signal to regulate the conductive path, and means for applying a potential between the first electrode and the third electrode which remains substantially the same when a ramp signal is applied to the first electrode.

3. The driver of claim 2, further including:

means for temporarily applying a first control signal to the third electrode to open the conductive path; and means for applying a high impedance to the third electrode so that the third electrode floats at a time when the ramp signal is being applied to the first electrode.

4. The driver of claim 3, wherein the first control signal corresponds to one of the first sampled data and the second sampled data.

5. The driver of claim 1, wherein the sample means comprises:

first switching means for sampling the data signal from the first data line in a first time period, and second switching means for sampling the data signal from the second data line in the second time period.

6. The driver of claim 1, further comprising demultiplexing means for providing a first data signal from the data channel to the first data line during the first time period for providing a second data signal from the data channel to the second data line during the second time period.

7. The driver of claim 1, wherein the data driver means includes a comparator means, the comparator means having:

differential pair means for comparing one of the first and second sampled signals to a reference signal to control the generation of the driving pulse, and current source means for generating a constant current signal for the differential pair means, the current source means including switching means having a conductive path between a first electrode and a second electrode where the second electrode is coupled to a negative voltage source, the switching means also has a third electrode for receiving a current source control signal to regulate the conductive path so that a source current signal flowing through the conductive path remains substantially constant.

8. The driver of claim 7, wherein the current source means further includes current mirror means for providing the constant current signal to the differential pairs means by mirroring the source current signal.

9. The driver of claim 8, wherein the differential pair means includes current load means for receiving a constant load current signal corresponding to the constant current signal.

10. The driver of claim 7, wherein the differential pair means includes current load means for receiving a constant load current signal corresponding to the constant current signal.

11. The driver of claim 1, wherein the sample means and data driver means are implemented using transistors which are only PMOS type transistors.

12. A data driver for a display, the data driver comprising:

means for providing a data signal from a data channel to a first data line and a second data line;

sample means for sampling the data signal from (1) the first data line to produce and store a first sampled data signal and (2) from the second data line to produce and store a second sampled signal; and data driver means for retrieving from the sample means, the first sampled data signal during a second time period and a second sampled data signal during a first time period and for transferring a driving pulse corresponding to one of the first sampled data signal and the second sampled data signal to the display, the data driver means having switching means which has a conductive path between a first electrode and a second electrode, the switching means also having a third electrode for receiving a control signal to regulate the conductive path, the data driver means also having means for applying a potential between the first electrode and the third electrode which remains substantially the same when a ramp signal is applied to the first electrode.

13. The driver of claim 12, further including:

means for temporarily applying a first control signal to the third electrode to open the conductive path; and means for applying a high impedance to the third electrode so that the third electrode floats at a time when the ramp signal is being applied to the first electrode.

14. The driver of claim 12, wherein the first control signal corresponds to one of the first sampled data and second sampled data.

15. A method for driving a display, the method comprising the steps of:

providing a data signal from a data channel to a first data line and a second data line;

alternately sampling the data signal (1) from the first data line to produce and store a first sampled data signal during a first time period and (2) from the second data line to produce and store a second sampled signal during a second time period;

retrieving from the sample means, the first sampled data signal during the second time period and the second sampled data signal during the first time period; and transferring a driving pulse corresponding to one of the first sampled data signal and the second sampled data signal to the display.

16. A method for driving a display, the method comprising the steps of:

providing a data signal from a data channel to a first data line and a second data line;

sampling the data signal from the first data line to produce and store a first sampled data signal and from the second data line to produce and store a second sampled signal;

retrieving the first sampled data signal and the second sampled data signal;

transferring a driving pulse corresponding to one of the first sampled data signal and the second sampled data signal to the display through a switch means having a conductive path between a first electrode and a second electrode which is controlled by a third electrode by maintaining a substantially constant potential between the first electrode and the third electrode when a ramp signal is applied to the first electrode.

17. The method of claim 16, further including the steps of:

temporarily applying a first control signal to the third electrode to close the conductive path; and applying a second control signal to the third electrode to open the conductive path at a time when the ramp signal is being applied to the third electrode.

18. A comparator means comprising:

differential pair means for comparing an input signal to a reference signal to generate a compared signal, and current source means for generating a constant current signal for the differential pair means, the current source means including:

(1) switching means having a conductive path between a first electrode and a second electrode where the second electrode is coupled to a negative voltage source, the switching means also has a third electrode; and (2) means for (a) initializing a source current signal flowing through the conductive path and (b) floating the third electrode of the switching means to regulate the conductive path so that the source current signal flowing through the conductive path remains substantially constant.

19. The comparator of claim 18, wherein the current source means further includes current mirror means for providing the constant current signal to the differential pairs means by mirroring the source current signal.

20. The comparator of claim 19, wherein the differential pair means includes current load means for receiving a constant load current signal corresponding to the constant current signal.

21. The comparator of claim 18, wherein the differential pair means includes current load means for receiving a constant load current signal corresponding to the constant current signal.

* * * * *